US005234323A

United States Patent [19]

Crinquette

[11] Patent Number: 5,234,323

[45] Date of Patent: Aug. 10, 1993

[54] FLUID POSITIVE DISPLACEMENT MACHINE WITH GAS INJECTION IN THE DISCHARGE REGION

[75] Inventor: Jean-Marie Crinquette, Annecy le Vieux, France

[73] Assignee: Alcatel CIT, Annecy le Vieux, France

[21] Appl. No.: 811,662

[22] Filed: Dec. 23, 1991

[30] Foreign Application Priority Data

Dec. 21, 1990 [FR] France ..... 90 16116

[51] Int. Cl.[5] ..... F04C 29/00

[52] U.S. Cl. ..... 418/83; 418/181

[58] Field of Search ..... 418/15, 83, 89, 90, 418/181

[56] References Cited

FOREIGN PATENT DOCUMENTS 0320956 6/1989 European Pat. Off. .
0338764 10/1989 European Pat. Off. .
0365695 5/1990 European Pat. Off. .
0385617 9/1990 European Pat. Off. .

OTHER PUBLICATIONS

Patent Abstracts of Japan, vol. 15, No. 69 (M-1083), Feb. 19, 1991, & JP-A-02 294589 (Unozawagumi Tekkosho K.K.) Dec. 5, 1990.

*Primary Examiner*—John J. Vrablik
*Attorney, Agent, or Firm*—Sughrue, Mion, Zinn, Macpeak & Seas

[57] ABSTRACT

A machine of the fluid entrainment or the positive displacement type, such as a compressor or a vacuum pump, in which injection of dry gas is effected in the discharge region of said machine or of one of its stages, wherein said injection is effected in a distributed manner over a surface.

2 Claims, 1 Drawing Sheet

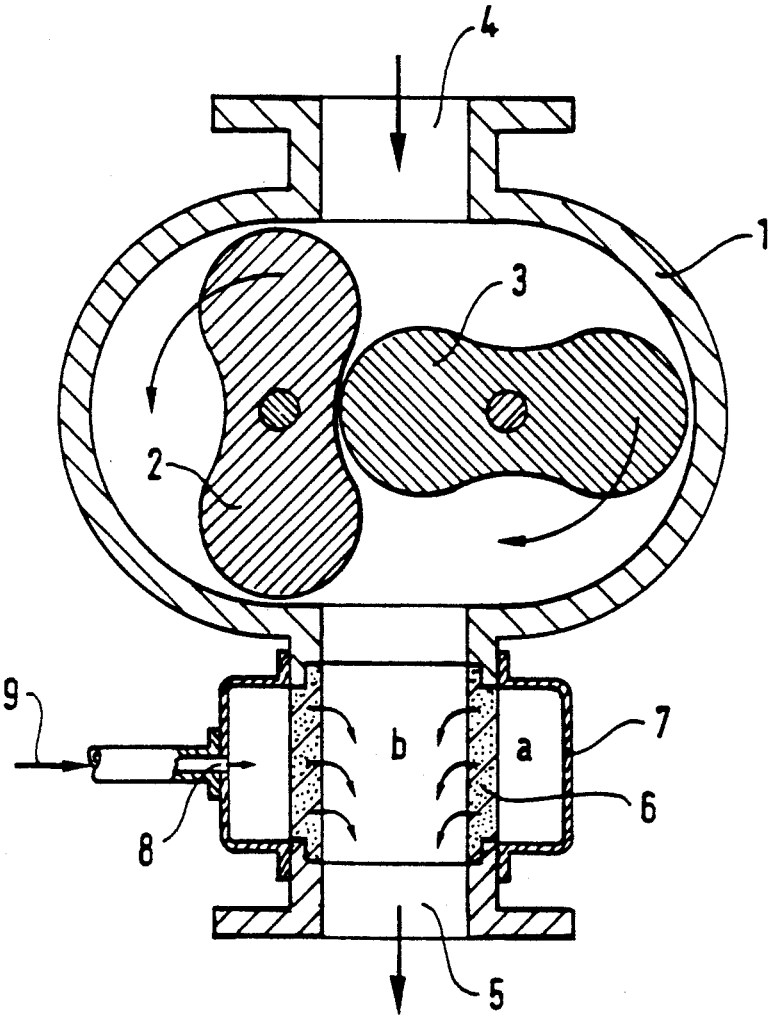
4
1
3
2
9
b
a
7
6
8
5

FLUID POSITIVE DISPLACEMENT MACHINE WITH GAS INJECTION IN THE DISCHARGE REGION

The present invention relates to a machine of the fluid entrainment or the positive displacement type, such as a compressor or a vacuum pump, with or without internal compression, for example a single or multi-stage Roots machine, possibly having claw-type rotors, a dry screw pump, a dry vane pump, a molecular pump, etc.

BACKGROUND OF THE INVENTION

In this type of machine one of the difficulties to be overcome when pumping with compression a gas which can condense or crystallize, in clogging of ducts, especially in the discharge region.

During compression, a gas which can condense or crystallize may be subjected to conditions in which it can pass through a change of state, with development of droplets or solid particles (crystals). This is especially frequent in the case of machines acting as a compressor or a vacuum pump and equipped with external or internal refrigeration.

The main problem with this phenomenon is the progressive blocking of ducts which leads to a loss of flow and thus to a damaging increase in internal losses (energy dissipated frictionally and excessive heating of the fluid and the machine). The risk of seizing up is one of the consequences. In some cases this may involve complete blockage of the ducts.

To avoid this phenomenon it is known to inject a certain amount of a dry gas, such as air, nitrogen, etc., into the discharge side of the machine, which limits the partial pressure of the pumped gas and thus avoids the change of state of the components which can condense or crystallize. Even if it is not enough to prevent the change of state, it allows particles to be put into suspension, so avoiding their deposition on the walls, through increasing the discharge flow and thus the flow velocity.

However this does not ensure effective protection for all the walls because the fluid only diffuses progressively in the duct and does not effectively protect either the discharge outlet of the machine or the first part of the downstream duct, which is however the most vulnerable and should be given the best protection.

SUMMARY OF THE INVENTION

An object of the invention is to provide improved protection and accordingly it provides a machine of the fluid entrainment for the positive displacement type, such as a compressor or a vacuum pump, in which injection of dry gas is effected in the discharge region of said machine or of one of its stages, wherein said injection is effected in a distributed manner over a surface.

According to a preferred implementation, said injection is effected through a porous wall.

BRIEF DESCRIPTION OF THE DRAWINGS

A description will now be given of an embodiment of the invention, which reference to the accompanying drawing comprising a single FIG. showing schematically a Roots machine in accordance with the invention.

DETAILED DESCRIPTION

The Roots machine, shown schematically, comprises a stator 1 and two rotors 2 and 3. The stator has an intake duct or port 4 and a discharge duct or port 5.

In accordance with the invention, a dry gas, for example dry air or nitrogen, is injected on the discharge side, in a distributed manner over a surface. To this end the wall 6 of the discharge duct is a porous wall surrounded by a jacket 7 having an opening 8 through which the gas symbolized by the arrow 9 is introduced.

For example, it is possible to use a wall made of sintered metal, a porous plastics material, an industrial fabric, a porous woven material, etc.

The gas 9 may be introduced at a pressure appreciably above atmospheric pressure, if for example a single-stage vacuum pump discharging to the atmosphere is concerned, but it may equally be lower than or equal to atmospheric pressure when the pressure level in the machine is low, as in the intermediate stages of a multi-stage vacuum pump. In this case, the pressure difference existing between the interior of the circuit, face b of the porous material 6, and the exterior, face a, may suffice to create the flow of the gas to be injected.

By virtue of this injection distributed over a surface and not localized as in the known prior art, the wall is protected by the formation of a fluid film. This protection spreads by expansion to the duct downstream of the region of distributed injection. Furthermore, as in the prior art, the dilution of the aspirated working gas by the injected gas reduces the partial pressure of the working gas, so avoiding condensation or crystallization, at least partially. The fluid film completely prevents deposition on the wall.

The porous wall 6 may be built into the machine but may equally well be provided as an auxiliary attachment to the machine.

Apart from the advantage of directly protecting the discharge side wall of the machine by the formation of a fluidized bed, the injection distributed over a surface by means of a porous wall reduce the sound level of the injection device, replacing the sonic expansion of a jet of gas by the progressive expansion through the porous medium.

The invention has been described as applied to a Roots machine but, as has been said above, it is applicable to any machine of the fluid entrainment or the positive displacement type, whether a pump or a compressor.

I claim:

1. In a fluid entrainment or positive displacement machine for pumping a gas, such as a compressor or a vacuum pump, including a stator supporting at least one rotor and having an intake duct and a discharge duct, and means for injecting a dry gas into the discharge of said machine for limiting the partial pressure of the pumped gas and tending to avoid change of state of components of the pumped gas, the improvement wherein said dry gas injecting means comprises means for effecting distribution of said dry gas over the interior surface of the wall of the discharge duct, such that the interior surface of said wall is protected by a fluid film of said dry gas thereby preventing deposition of solid particles by change of state on the interior wall and clogging of the discharge duct, and wherein said wall of said discharge duct is a porous wall and comprises a part of said distribution effecting means for said dry gas.

2. The machine as claimed in claim 1, wherein a jacket surrounds the exterior surface of said porous wall and is spaced therefrom, and said jacket includes an opening therein for introducing said dry gas to the space between said jacket and the exterior surface of said porous wall.

* * * * *